US007045724B1

(12) United States Patent
Chou

(10) Patent No.: US 7,045,724 B1
(45) Date of Patent: May 16, 2006

(54) JERK-INITIATED SWITCH

(76) Inventor: Tien-Ming Chou, No. 41, San-Hsi 5th St., Taichung City (TW)

( * ) Notice: Subject to any disclaimer, the term of this patent is extended or adjusted under 35 U.S.C. 154(b) by 0 days.

(21) Appl. No.: 11/023,755

(22) Filed: Dec. 28, 2004

(51) Int. Cl.
*H01H 3/16* (2006.01)

(52) U.S. Cl. ..... 200/61.45 R; 200/52 A; 200/61.52

(58) Field of Classification Search ..... 200/61.45 R, 200/61.46–61.53, 52 A
See application file for complete search history.

(56) References Cited

U.S. PATENT DOCUMENTS 6,198,059 B1 * 3/2001 Jou ..... 200/61.52
6,518,523 B1 * 2/2003 Chou ..... 200/61.52
6,559,396 B1 * 5/2003 Chou ..... 200/61.52
6,740,867 B1 * 5/2004 Chou ..... 250/231.1
2003/0057361 A1 * 3/2003 Chou ..... 250/221
2003/0066742 A1 * 4/2003 Chou ..... 200/61.45 R

* cited by examiner

*Primary Examiner*—Elvin Enad
*Assistant Examiner*—Lheiren Mae A. Anglo
(74) *Attorney, Agent, or Firm*—Frommer Lawrence & Haug LLP; Ronald R. Santucci

(57) ABSTRACT

A jerk-initiated switch includes an insulating housing with an inner bottom wall surface, a plurality of electric contact terminals having contact protrusions disposed in the housing to form a polygon, and an electrically conductive ball rollable on the inner bottom wall surface and having a spherical radius of a dimension that is larger than a length from a polygonal center to a polygonal side, and that is smaller than a diagonal section from the polygonal center to a vertex of the polygon. The topography of a central area of the inner bottom wall surface is configured such that the ball is displaced from an upright position where it rests on the central area to a jerked position where it is out of the central area so as to establish different switching states.

10 Claims, 23 Drawing Sheets

JERK-INITIATED SWITCH

BACKGROUND OF THE INVENTION

1. Field of the Invention

This invention relates to a jerk-initiated switch, more particularly to a jerk-initiated switch having an electrically conductive ball rollable within an insulating housing to engage or disengage two adjacent electric contact terminals.

2. Description of the Related Art

Referring to FIG. 1, a conventional vibration switch 1 capable of instantly changing its switching state when jerked by a force coming from any direction is shown to include a housing 12 having an arcuate rolling surface 121 and an integrally formed terminal 122 extending from the rolling surface 121, an electric contact body 13 spaced apart from the housing 12 and having an arcuate rolling surface 131 and an integrally formed terminal 132 extending from the rolling surface 131, and two electrically conductive balls 11 disposed to be rollable on the rolling surfaces 121, 131, respectively. The balls 11 are configured to be displaceable towards one of farthermost areas of the rolling surfaces 121, 131 when the housing 12 is caused to quiver in an unsteady state, so that one of the balls 11 is out of contact with the corresponding rolling surface 121, 131 to break the electric contact between the terminals 122, 132. However, in order to warrant the electric contact between the balls 11 and the terminals 122, 132, the rolling surface 121 of the housing 12 has to be subjected to an electroplating process, thereby resulting in inconvenience during manufacturing.

SUMMARY OF THE INVENTION

The object of the present invention is to provide a jerk-initiated switch which can warrant electric contact between two electric contact terminals without the need for electroplating an insulating housing so as to facilitate manufacture of the switch at a relatively low cost.

According to this invention, the jerk-initiated switch includes an insulating housing adapted to be mounted on a support in an upright direction, and having an inner bottom wall surface, and an inner peripheral wall surface which extends upwardly from a periphery of the inner bottom wall surface and which defines an accommodation chamber therein. The inner bottom wall surface has a central area and a circumferential area surrounding the central area. A plurality of electric contact terminals are displaced angularly from one another about a centerline which extends from the central area in the upright direction. Each of the electric contact terminal includes a shank extending in the upright direction, and a contact protrusion extending radially from the shank and having a portion protruding toward the centerline such that the portions of the contact protrusions form vertices of a polygon that defines a horizontal plane intersecting the centerline at a polygonal center. The polygon has a pair of first vertices connected by a first diagonal, and a pair of second vertices connected by a second diagonal, the first and second diagonals passing through the polygonal center respectively, and first and second polygonal sides that interconnect a corresponding one of the first vertices with the second vertices adjacent thereto. The polygonal center is distant from the central area along the centerline, the corresponding one of the first vertices, one of the two second vertices adjacent thereto, the first polygonal side, and the second polygonal side, respectively, by a height, a first diagonal section, a second diagonal section, a first length, and a second length, respectively. An electrically conductive ball is disposed to be rollable on the inner bottom wall surface, and has a spherical radius of a dimension that is larger than both the height and the longer one of the first and second lengths, and that is smaller than the shorter one of the first and second diagonal sections. The central area has topography configured such that the electrically conductive ball is displaced from an upright position, where the electrically conductive ball rests on the central area to establish a first switching state between two adjacent ones of the contact protrusions through one of engagement and disengagement with the electrically conductive ball, to a jerked position where the electrically conductive ball is jerked out of the central area to establish a second switching state between the two adjacent ones of the contact protrusions through the other one of engagement and disengagement with the electrically conductive ball.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
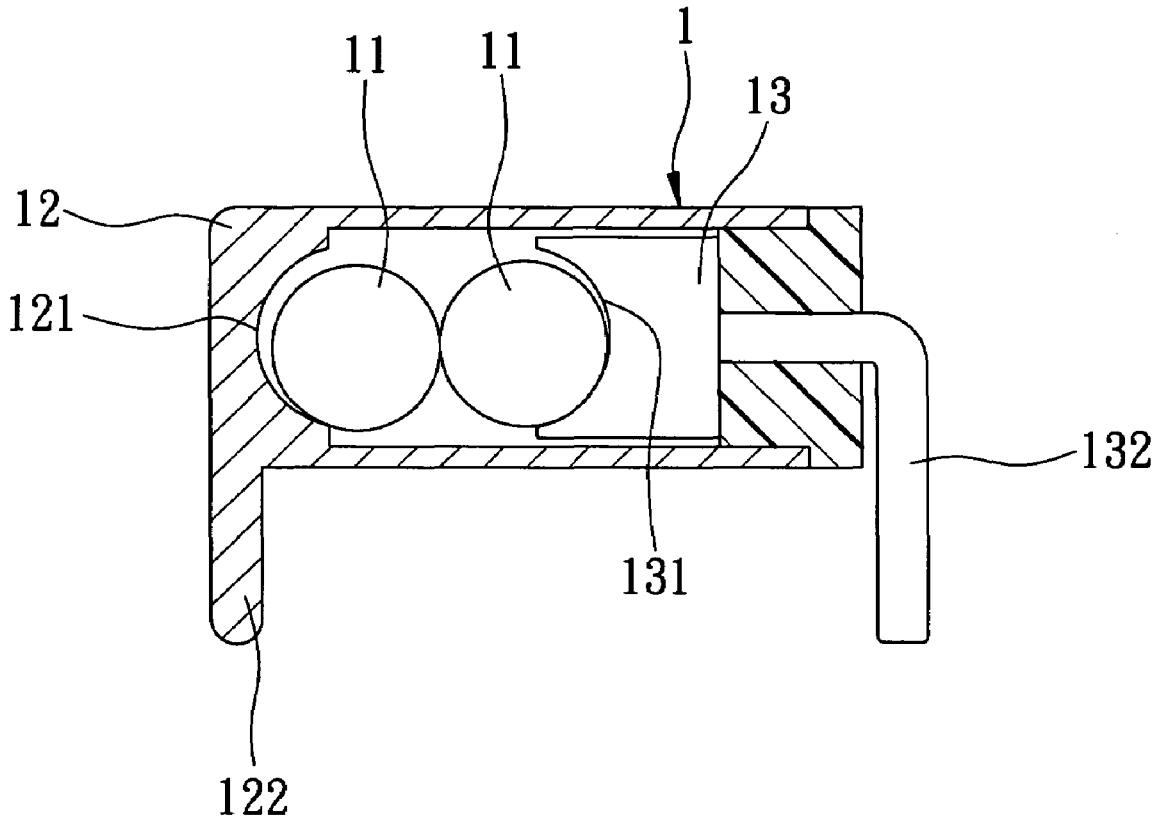
FIG. 1 PRIOR ART
FIG. 1 is a sectional view of a conventional vibration switch.
Figure 2:
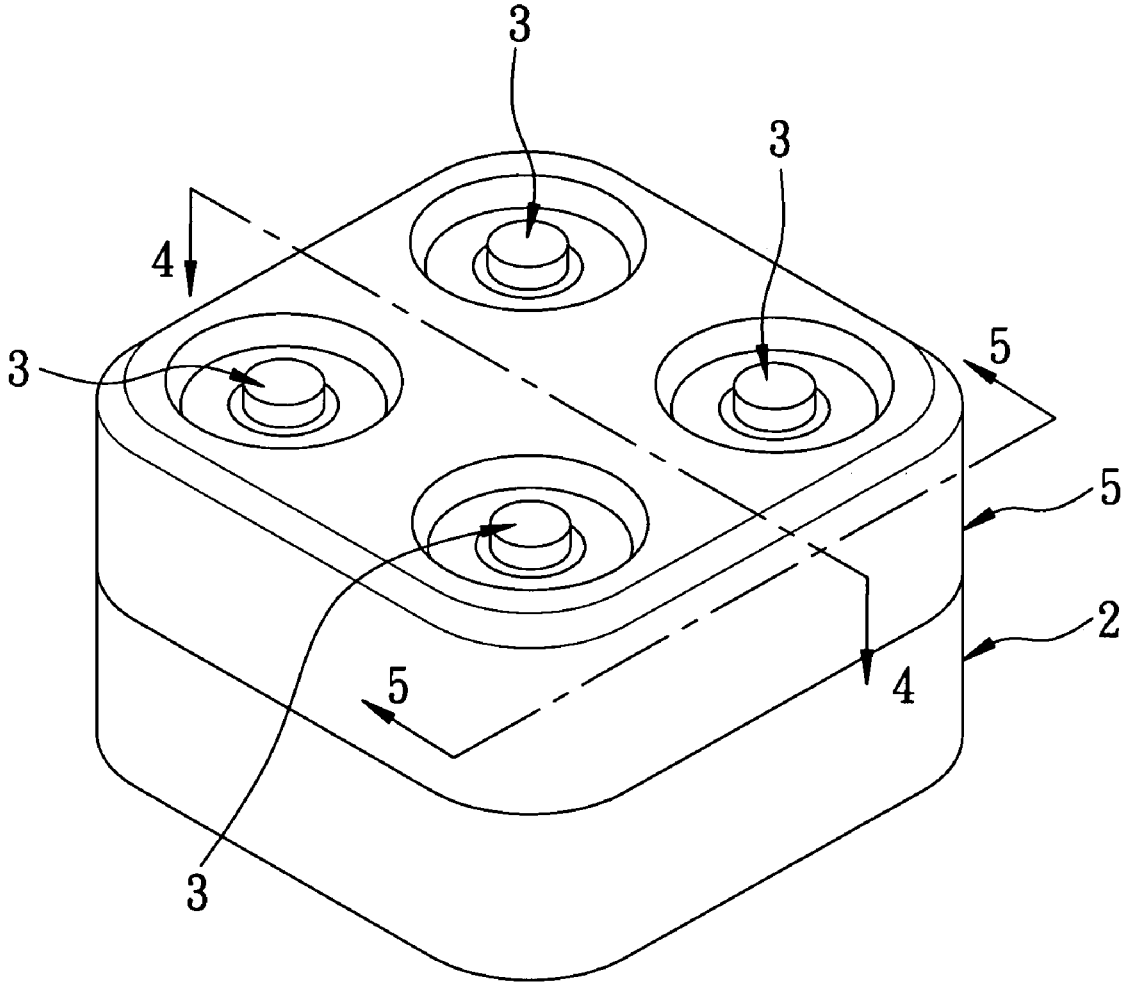
FIG. 2 is a perspective view of a first preferred embodiment of a jerk-initiated switch according to this invention.
Figure 3:
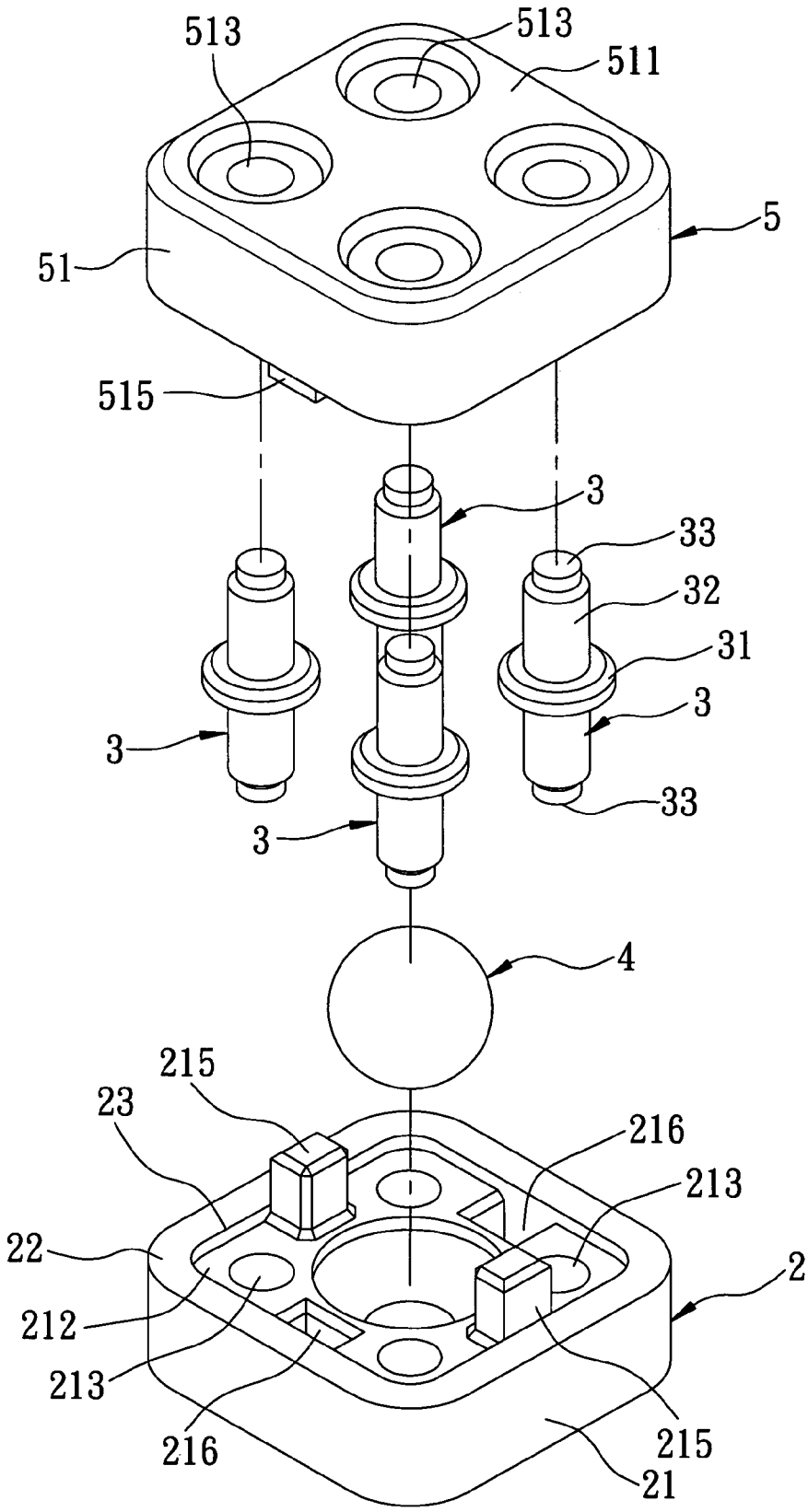
FIG. 3 is an exploded perspective view of the first preferred embodiment.

Before the present invention is described in greater detail, it should be noted that same reference numerals have been used to denote like elements throughout the specification.

Referring to FIGS. 2 to 5, a first preferred embodiment of a jerk-initiated switch according to the present invention is shown to comprise an insulating housing including modular upper and lower halves 5, 2 fitted to each other, four electric contact terminals 3, and an electrically conductive ball 4.

The lower half 2 is adapted to be mounted on a support 100 in an upright direction, and includes a bottom wall 21 with inner bottom wall surface 212 and an outer bottom wall surface 211 opposite to the inner bottom wall surface 212 in an upright direction to be mounted on the support 100, and an inner peripheral wall surface 23 which extends upwardly from a periphery of the inner bottom wall surface 212 to terminate at an edge 22. The inner bottom wall surface 212 has a central area 2121 and a circumferential area 2122 surrounding the central area 2121, four through holes 213 which extend through the outer bottom wall surface 211 in the upright direction and which are equi-angularly displaced from one another about a centerline in the upright direction, and two engaging plugs 215 and two engaging sockets 216, each of which is disposed between two adjacent ones of the through holes 213. In this embodiment, the central area 2121 is in the form of a concavity and converges to the centerline. The upper half 5 includes a top wall 51 with outer and inner top wall surfaces 511, 512, and a peripheral wall 52 which extends from the top wall 51 and which abuts against the edge 22 so as to cooperatively define an accommodation chamber 25. The top wall 51 has four mounting holes 513 which extend therethrough and which are respectively registered with the through holes 213 in the upright direction, and two engaging plugs 515 and two engaging sockets 516 which fittingly and respectively engage the engaging sockets 216 and the engaging plugs 215 to couple the upper half 5 to the lower half 2.

Each of the electric contact terminals 3 includes a shank 32 which extends in the upright direction, and which has upper and lower segments that are received in the respective mounting hole 513 and the respective through hole 213, upper and lower electrically conductive segments 33 that extend outwardly of the mounting hole 513 and the through hole 213, respectively, and a contact protrusion 31 which extends radially from the shank 32. Each contact protrusion 31 has a portion protruding toward the centerline to form one of four vertices of a square (S) that defines a horizontal plane intersecting the centerline at a polygonal center.

The square (S) has a pair of first vertices connected by a first diagonal and a pair of second vertices connected by a second diagonal, the first and second diagonals passing through the polygonal center, and first and second polygonal sides that interconnect a corresponding one of the first vertices with the second vertices adjacent thereto. The polygonal center is distant from a topmost point of the central area 2121 along the centerline, the corresponding one of the first vertices, one of the two second vertices adjacent thereto, the first polygonal side, and the second polygonal side, respectively, by a height (h), a first diagonal section (d1), a second diagonal section (d2), a first length (L1) and a second length (L2) respectively. In this embodiment, the first diagonal section (d1) is equal to the second diagonal section (d2), and the first length (L1) is equal to the second length (L2).

The electrically conductive ball 4 is received in the accommodation chamber 25, and is rollable on the inner bottom wall surface 212. The ball 4 has a spherical radius of a dimension that is larger than both the height (h) and the first and second lengths (L1, L2), and that is smaller than the first and second diagonal sections (d1, d2).

Figure 4:
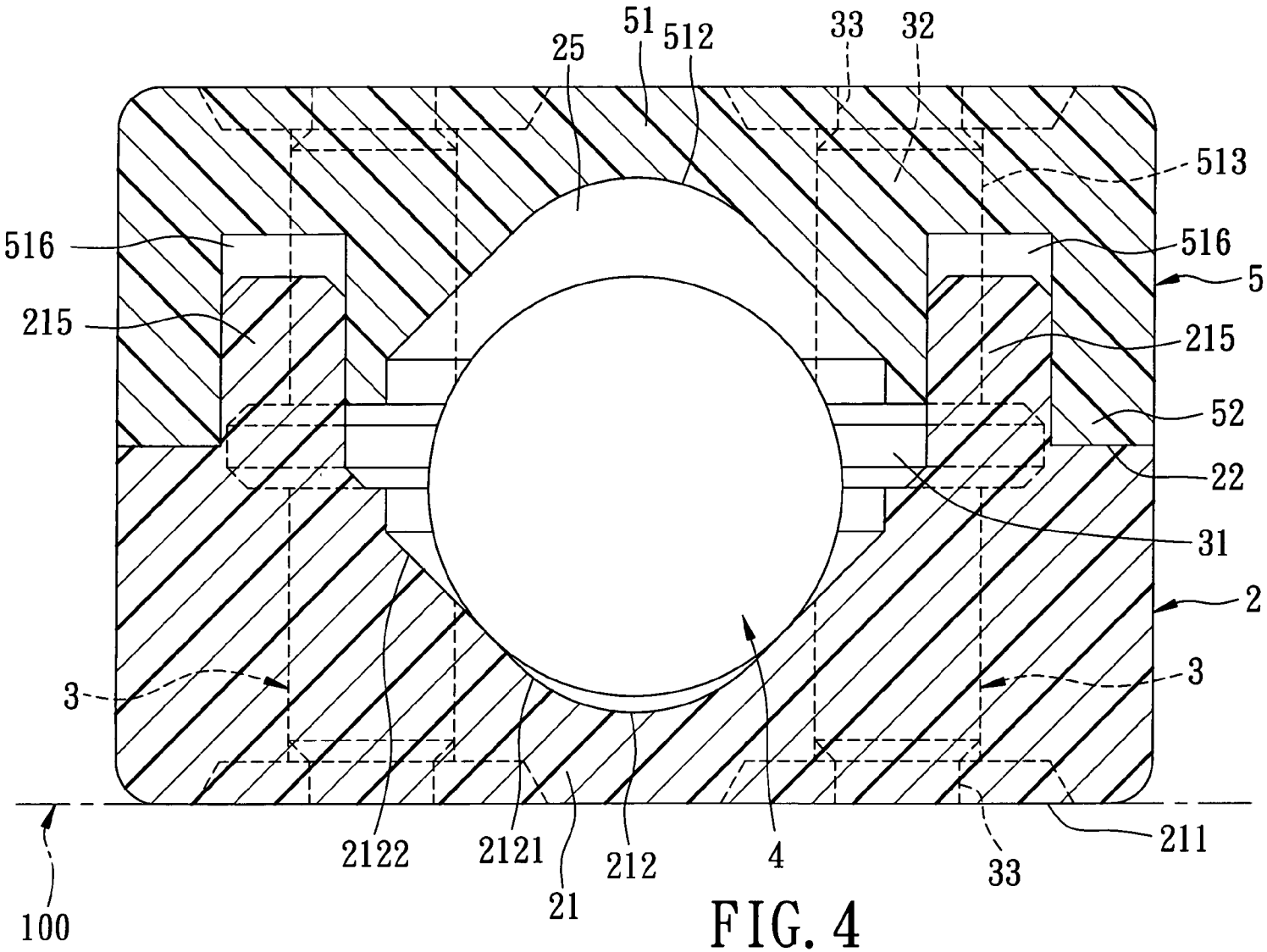
FIG. 4 is a longitudinally sectional view of the first preferred embodiment in an upright state, taken along lines 4—4 of FIG. 2.
Figure 5:
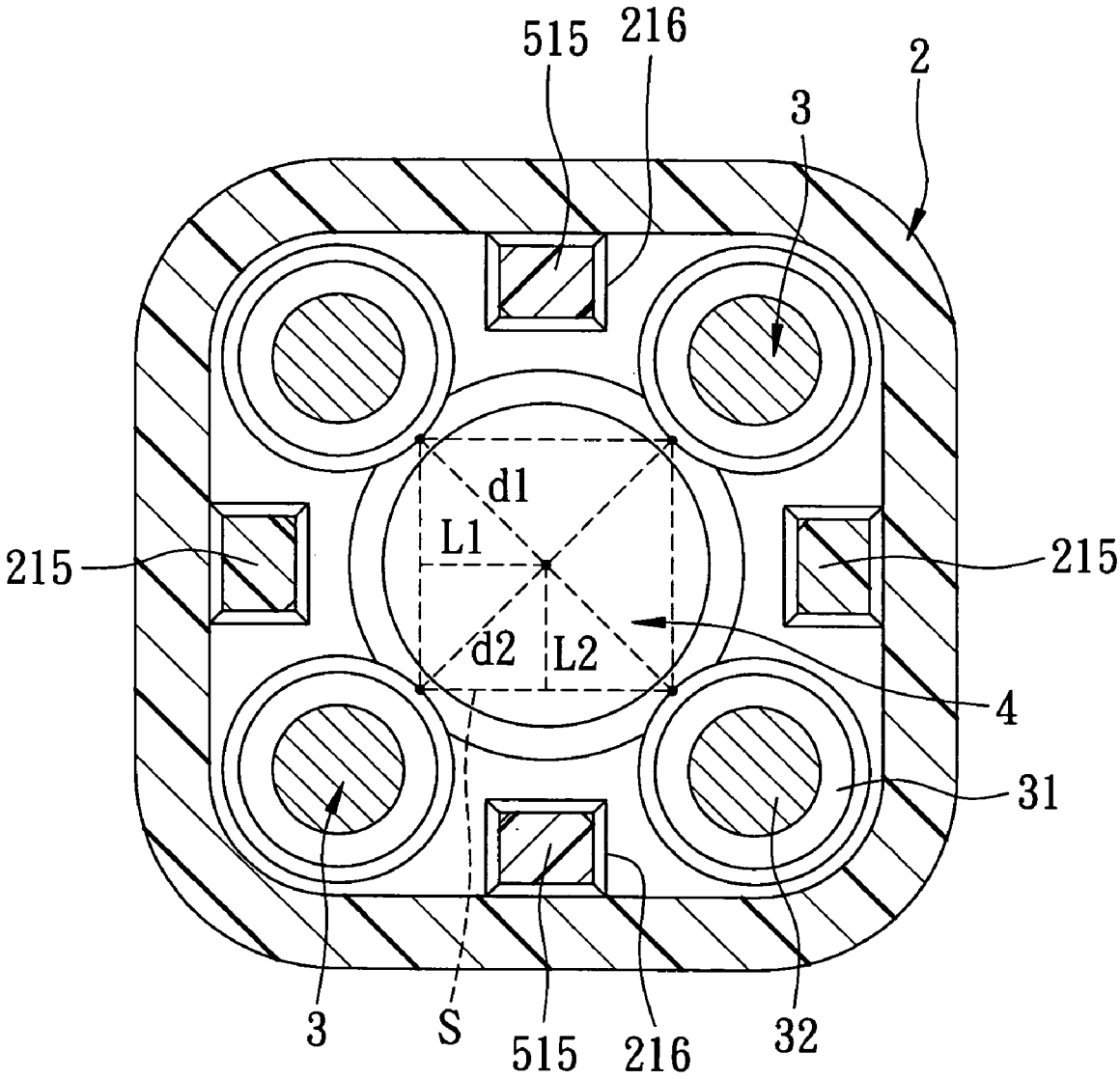
FIG. 5 is a cross-sectional view of the first preferred embodiment in the upright state, take along lines 5—5 of FIG. 2.
Figure 6:
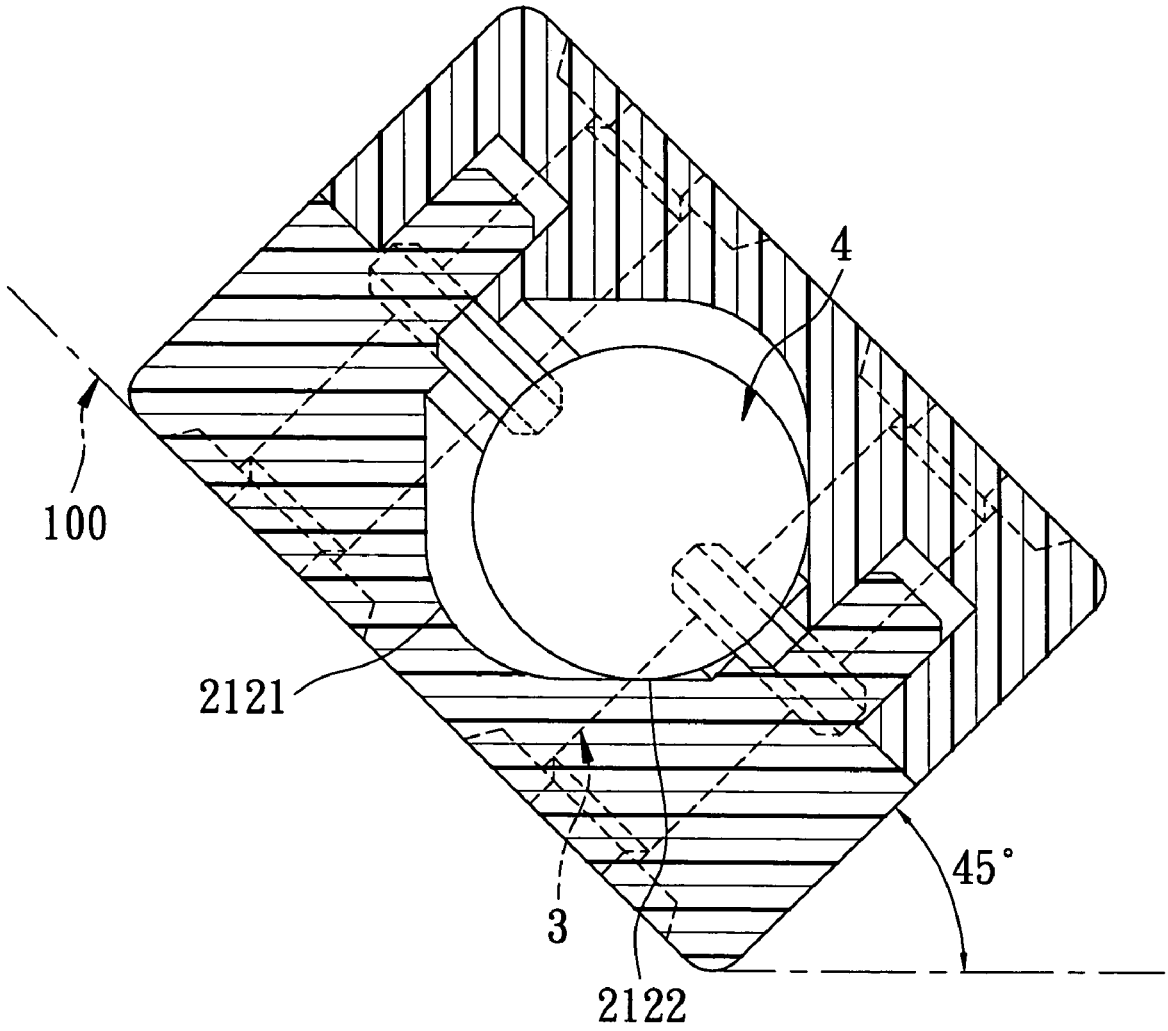
FIG. 6 is a view similar to FIG. 4 but showing the first preferred embodiment in a tilted state.
Figure 7:
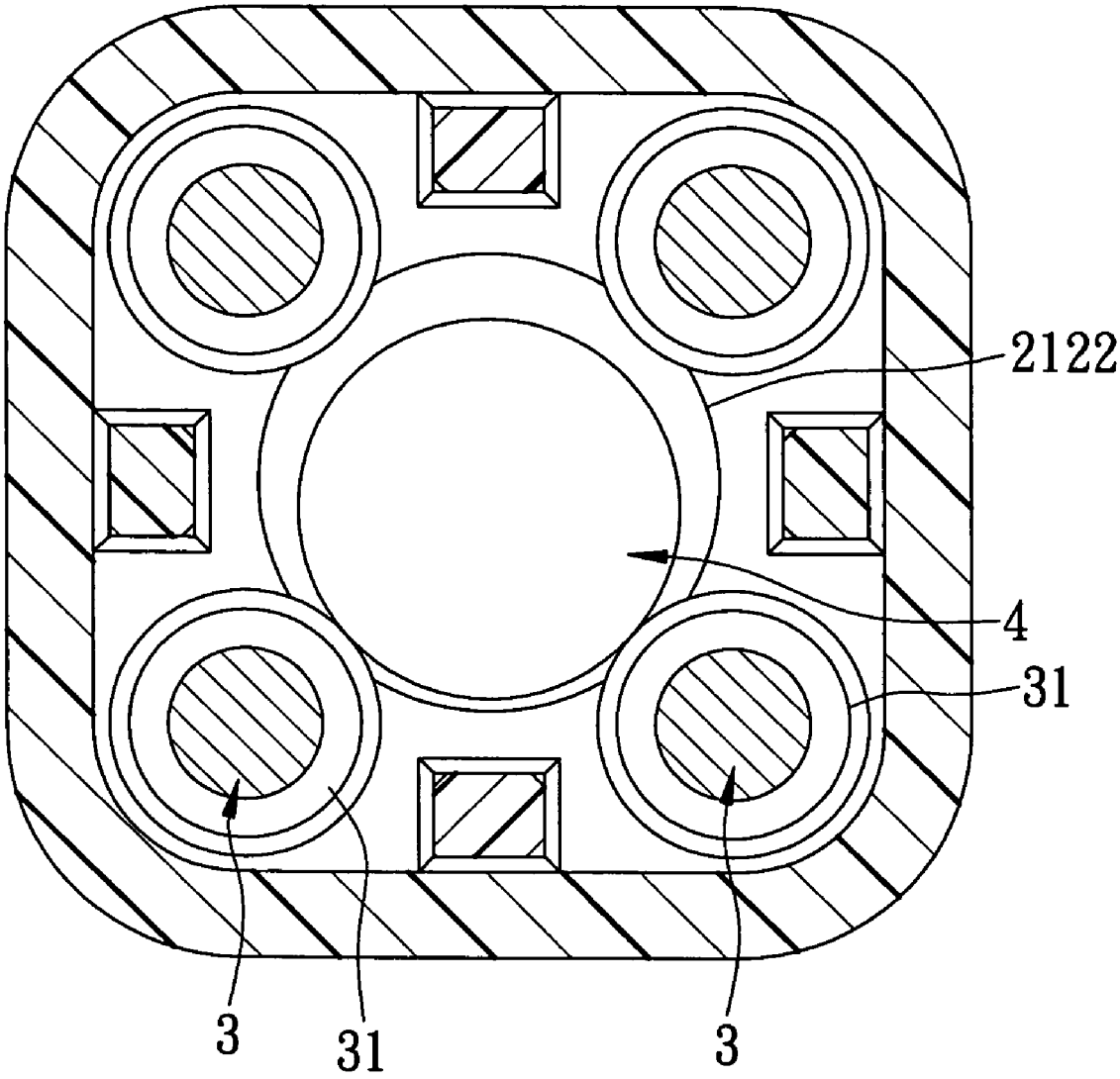
FIG. 7 is a view similar to FIG. 5 but showing the first preferred embodiment in the tilted state.

Due to the concave form of the inner bottom wall surface 212, the ball 4 is displaced from an upright position, as shown in FIGS. 4 and 5, where the ball 4 rests on the central area 2121 with a spherical center thereof located at the centerline, and disengages any two adjacent ones of the contact protrusions 31 so as to break electric contact therebetween, thereby placing the switch in a first switching state, i.e. a switch-off state, to a jerked position, e.g. tilted at 45 degrees, as shown in FIGS. 6 and 7, where the ball 4 is displaced to the circumferential area 2122 and engages two adjacent ones of the contact protrusions 31 so as to establish the electric contact therebetween, thereby placing the switch in a second switching state, i.e. the switch-on state.

Preferably, the inner top wall surface 512 confronts the inner bottom wall surface 212, and the topography of the inner top wall surface 512 is configured to be a mirror image of the inner bottom wall surface 212 so as to ensure that the ball 4 rests on the circumferential area 2122 when the ball 4 is in the jerked position.

Accordingly, only the electric contact terminals 3 and the ball 4 need to be electroplated. There is no need to electroplate the housing. Thus, the switch of this invention can be manufactured at a relatively low cost.

Figure 8:
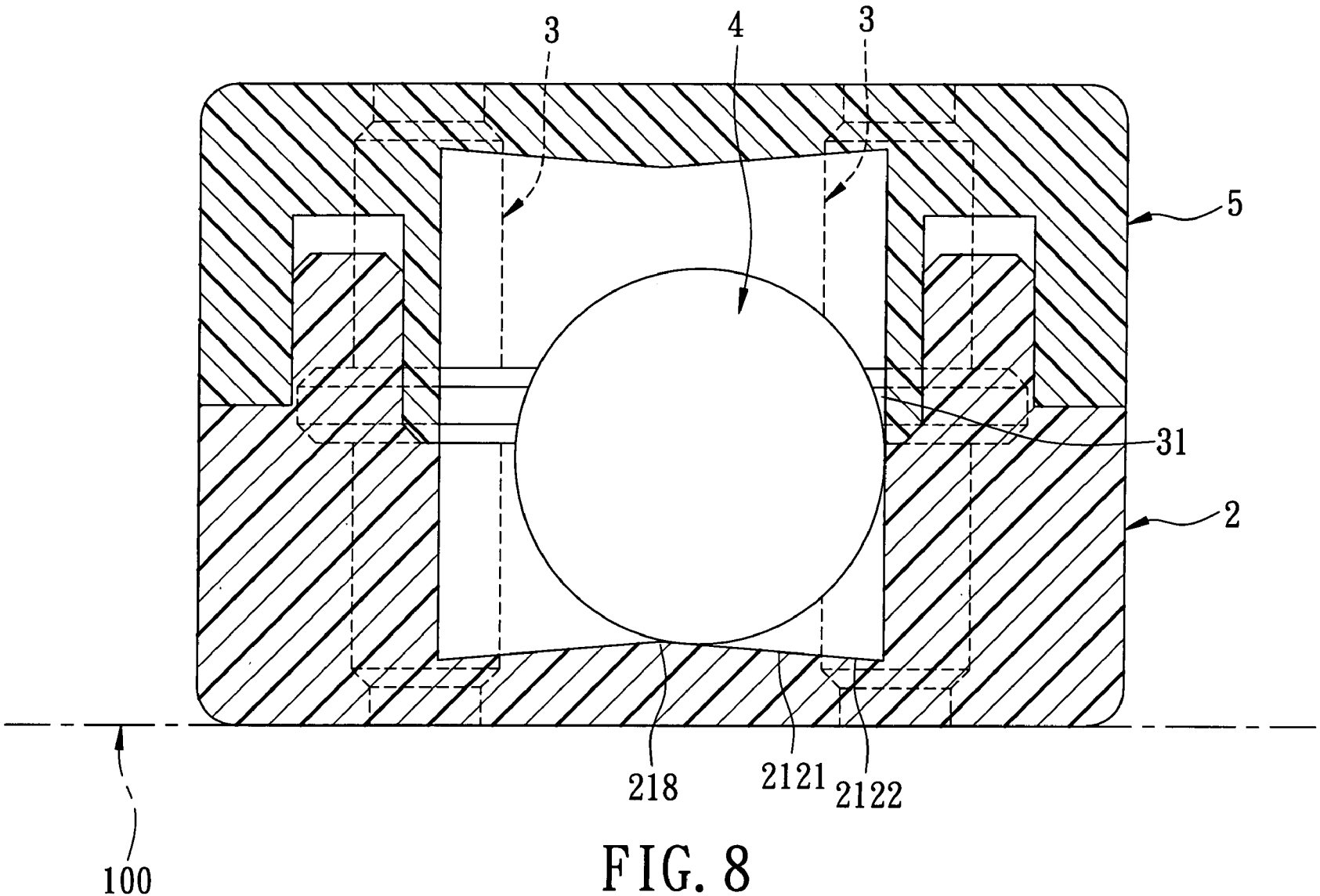
FIG. 8 is a longitudinally sectional view of a second preferred embodiment of the jerk-initiated switch according to this invention in an upright state.
Figure 9:
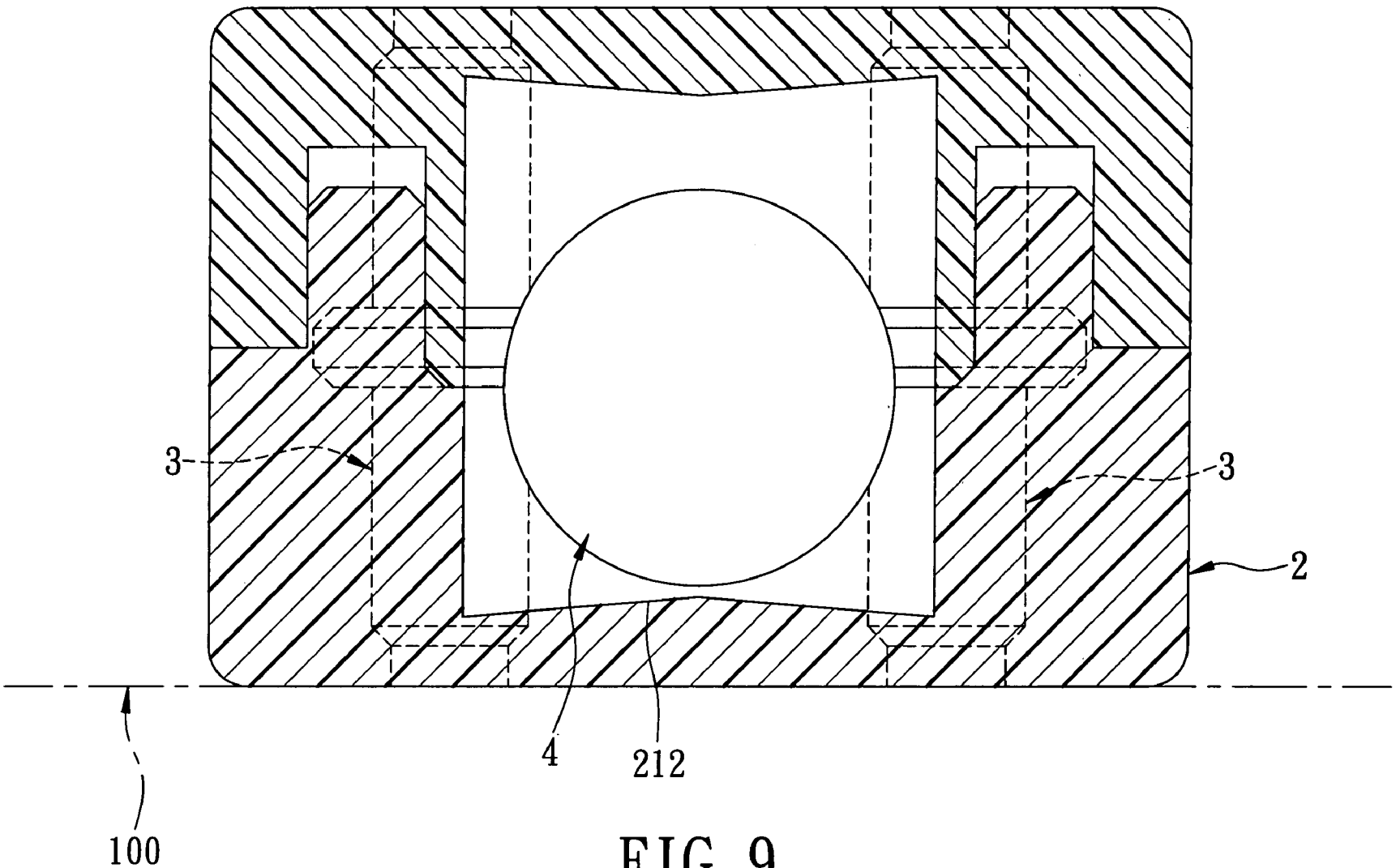
FIG. 9 is a longitudinally sectional view of the second preferred embodiment in a vibrated state.

Referring to FIGS. 8 and 9, the second preferred embodiment of a jerk-initiated switch according to this invention is shown to be similar to the first preferred embodiment in construction. In this embodiment, the central area 2121 is in the form of a convexity with a topmost point 218 located at the centerline such that in the upright position, as shown in FIG. 8, the spherical center of the ball 4 is offset from the centerline as a result of gravity to enable the ball 4 to engage two adjacent ones of the contact protrusions 31 so as to establish the electric contact therebetween, thereby placing the switch in the first switching state, i.e. a switch-on state. As shown in FIG. 9, the ball 4 is flung from the inner bottom wall surface 212 as a result of quivering of the housing so that the ball 4 disengages any two adjacent ones of the contact protrusions 31 so as to break the electric contact therebetween, thereby placing the switch in the second switching state, i.e. the switch-off state.

Figure 10:
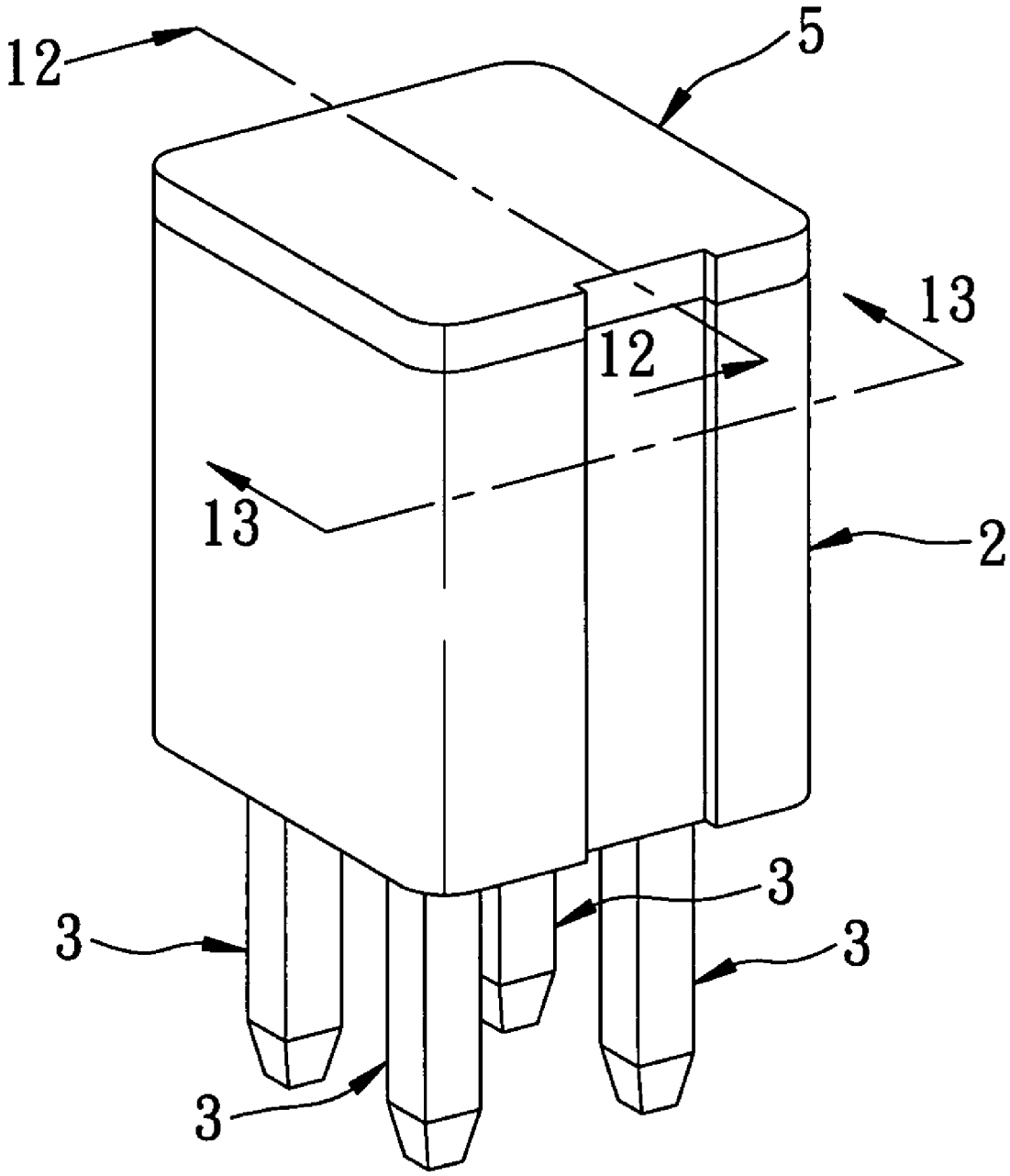
FIG. 10 is a perspective view of a third preferred embodiment of the jerk-initiated switch according to this invention.
Figure 11:
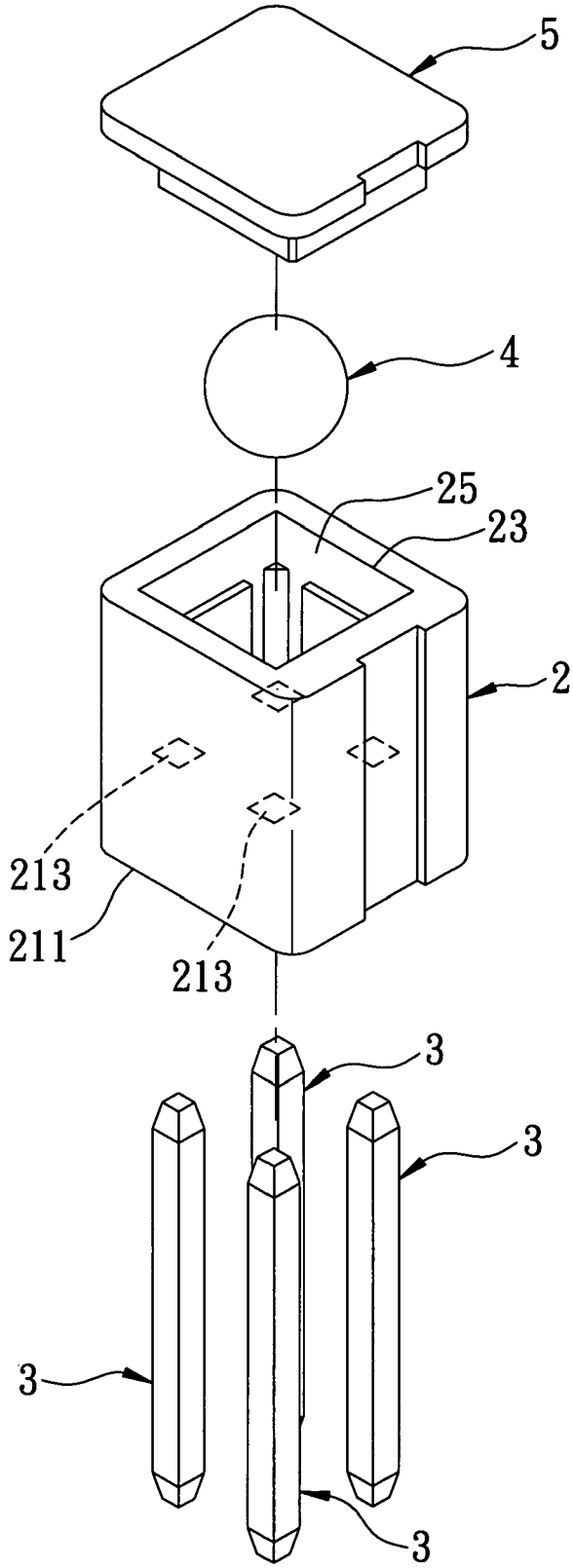
FIG. 11 is an exploded perspective view of the third preferred embodiment.
Figure 12:
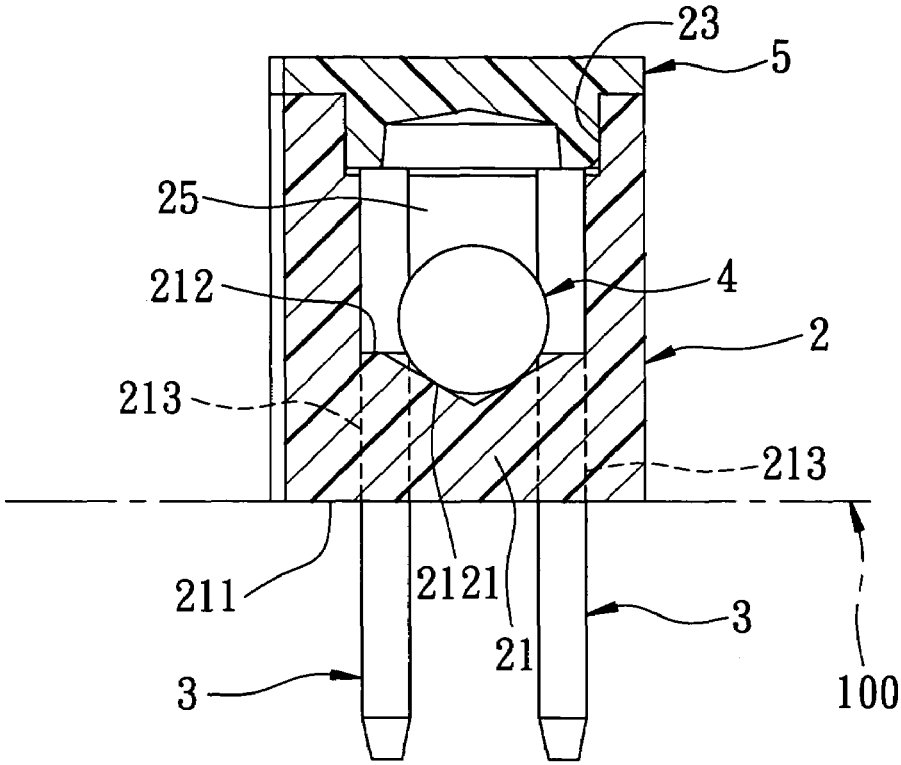
FIG. 12 is a longitudinally sectional view of the third preferred embodiment in an upright state, taken along lines 12—12 of FIG. 10.
Figure 13:
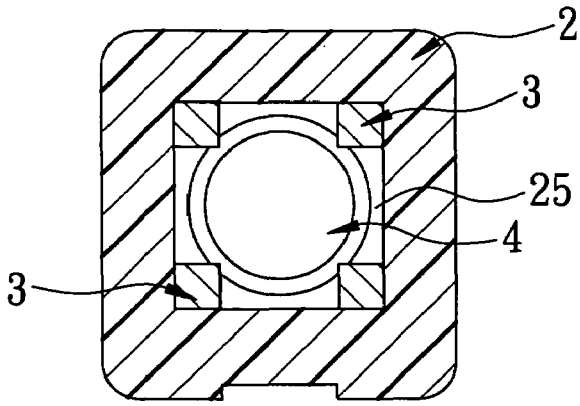
FIG. 13 is a cross-sectional view of the third preferred embodiment in the upright state, taken along 13—13 of FIG. 10.
Figure 14:
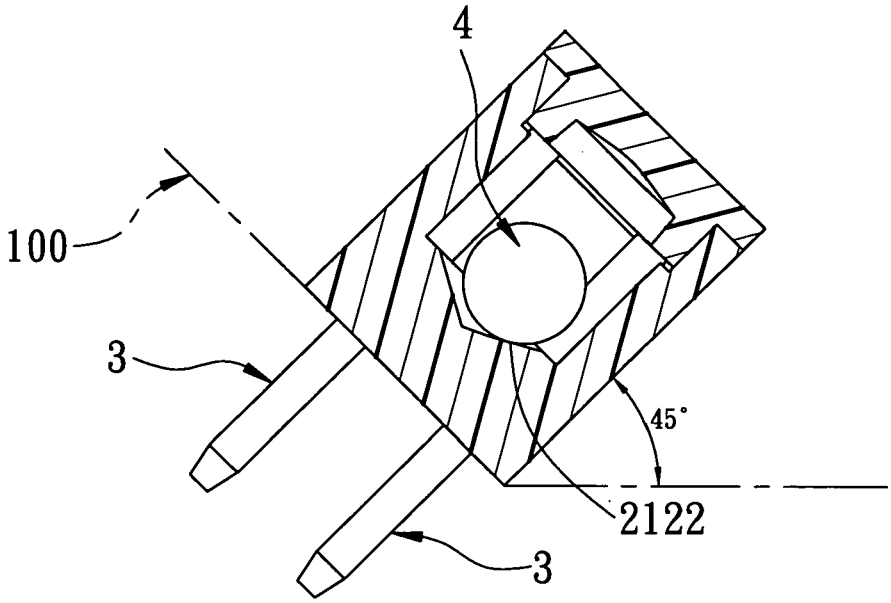
FIGS. 14 and 15 are views similar to FIG. 13 but showing the third preferred embodiment in a tilted state.
Figure 15:
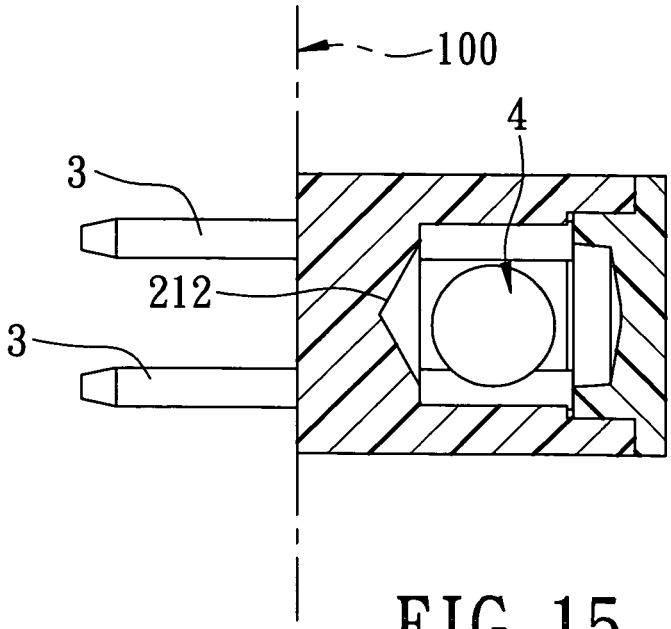
Figure 16:
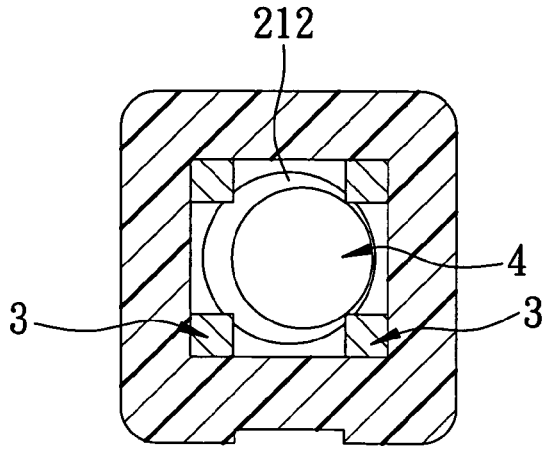
FIG. 16 is a view similar to FIG. 13 but showing the third preferred embodiment in the tilted state.

Referring to FIGS. 10 to 12, the third preferred embodiment of a jerk-initiated switch according to this invention is shown to be similar to the first preferred embodiment in construction. In this embodiment, the upper half 5 of the housing is formed as a plastic cap which has a periphery abutting against an edge of the inner peripheral wall surface 23 of the lower half 2 and which is spaced apart from the inner bottom wall surface 212 in the upright direction to define the accommodation chamber 25. The cap is coupled with the lower half 2 of the housing by a high-frequency welding process. As shown in FIGS. 12 and 13, in the upright position, the ball 4 rests on the central area 2121 and is disengaged from any one of the electric contact terminals 3 so as to break the electric contact therebetween, thereby disposing the switch in a switch-off state. As shown in FIGS. 14 to 16, when the support 100 is subjected to a tilting force and the switch is tilted by 45 degrees or even 90 degrees, the ball 4 is displaced to the circumferential area 2122 or is flung from the inner bottom wall surface 212, and engages two adjacent ones of the electric contact terminals 3 so as to establish the electric contact therebetween, thereby placing the switch in a switch-on state.

Figure 17:
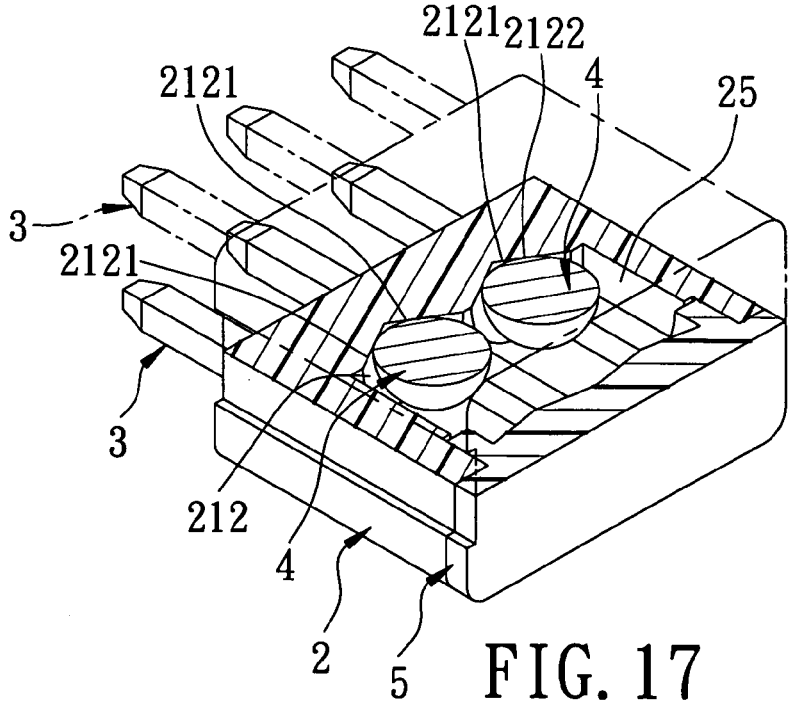
FIG. 17 is a partly cutaway perspective view of a fourth preferred embodiment of the jerk-initiated switch according to this invention.
Figure 18:
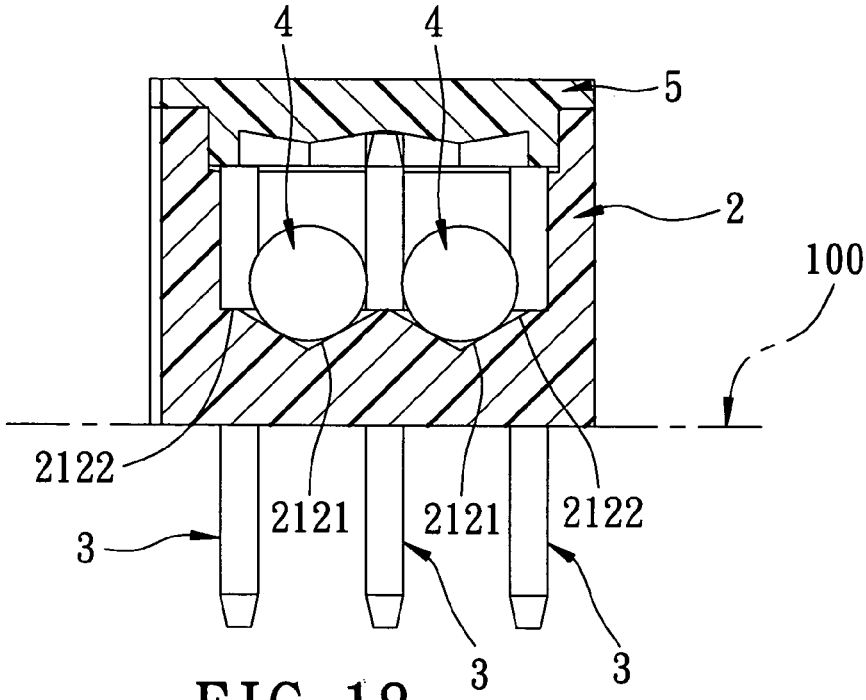
FIG. 18 is a longitudinally sectional view of the fourth preferred embodiment in an upright state.

Referring to FIGS. 17 and 18, the fourth preferred embodiment of a jerk-initiated switch according to this invention is shown to be similar to the third preferred embodiment in construction. The inner bottom wall surface 212 extends outwardly of two adjacent ones of the electric contact terminals 3 to form an additional central area 2121 in the form of a concavity and an additional circumferential area 2122. In addition, the switch further comprises two additional electric contact terminals 3 and an additional electrically conductive ball 4.

The two additional electric contact terminals 3 and the two adjacent ones of the electric contact terminals 3 are angularly displaced from one another around the additional central area 2121. The additional electric contact terminals 3 respectively include contact protrusions that cooperate with the contact protrusions of the electric contact terminals 3 to form four vertices of a square. The additional central and circumferential areas 2121, 2122 and the additional electric contact terminals 3 are configured to be identical to the central and circumferential areas 2121, 2122 and the electric contact terminals 3 in the previous embodiments. The additional electrically conductive ball 4 is configured to be identical to the electric conductive ball 4 in the previous embodiments, and is rollable on the additional central area 2121 and the additional circumferential area 2122 so as to engage or disengage two adjacent ones of the contact protrusions of the additional electric contact terminals 3 and the two adjacent ones of the electric contact terminals 3.

Figure 19:
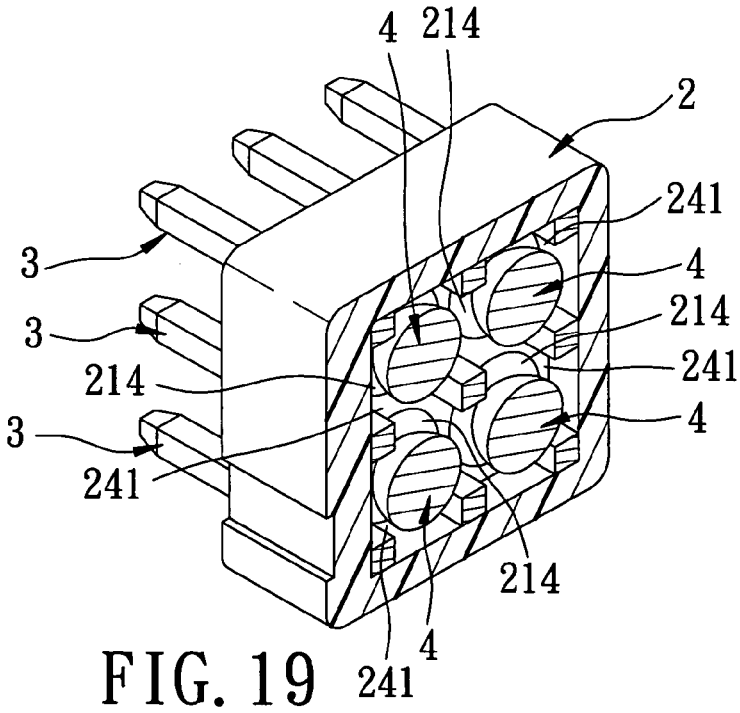
FIG. 19 is a partly cutaway perspective view of a fifth preferred embodiment of the jerk-initiated switch according to this invention.

In the fifth preferred embodiment of the jerk-initiated switch according to this invention as shown in FIG. 19, the inner bottom wall surface 212 further extends in width wise and length wise directions to form three additional central areas in the form of concavities 214 and three additional circumferential areas. Furthermore, five electric contact terminals 3 are additionally provided to cooperate with the four electric contact terminals 3 to define four squares that respectively confront the four concavities so as to divide the accommodation chamber into four rolling regions 241. Three additional electrically conductive balls 4 are additionally disposed in the rolling regions 241, respectively. An increased number of the electrically conductive balls 4 can improve sensitivity of the switch.

Figure 20:
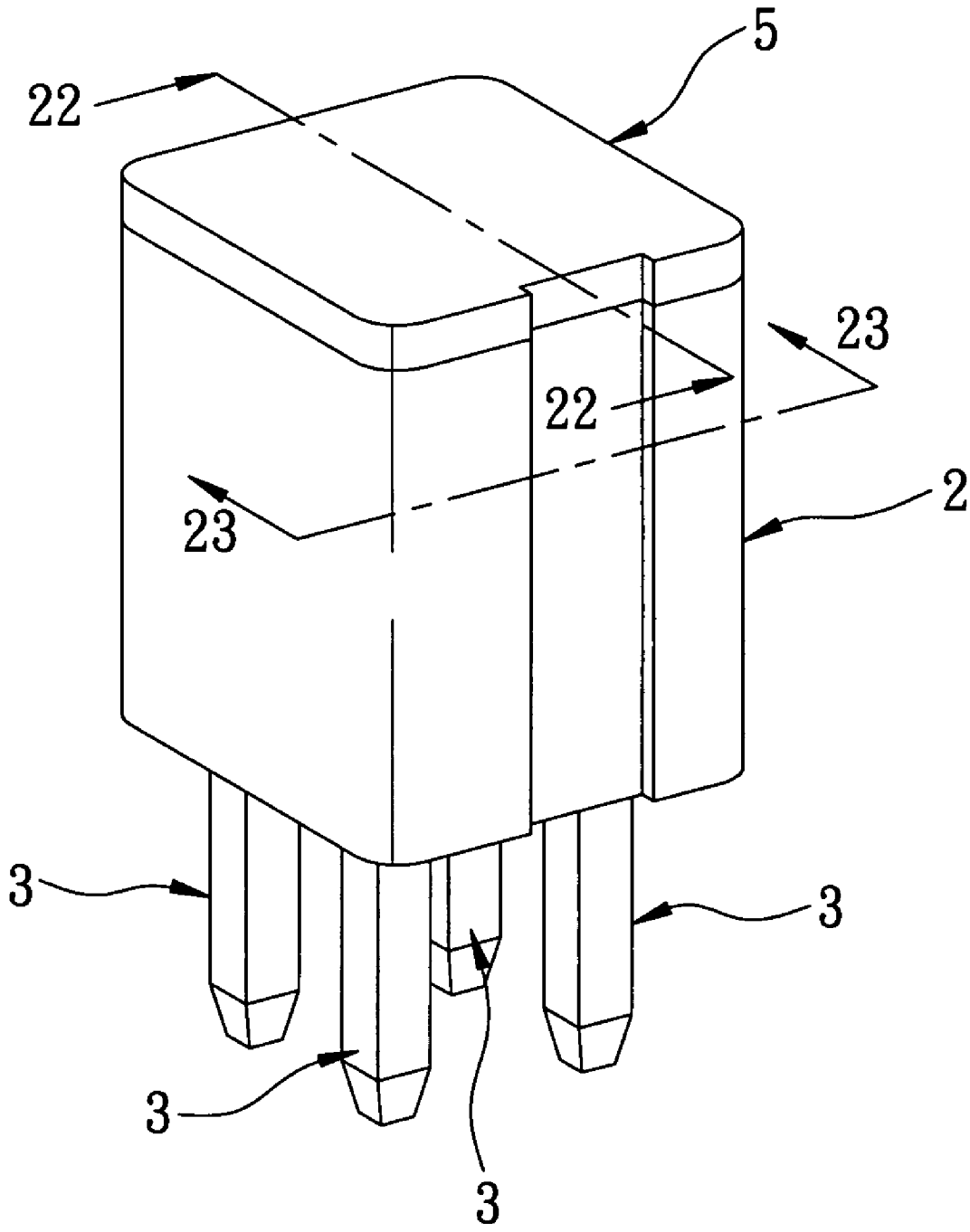
FIG. 20 is a perspective view of a sixth preferred embodiment of the jerk-initiated switch according to this invention.
Figure 21:
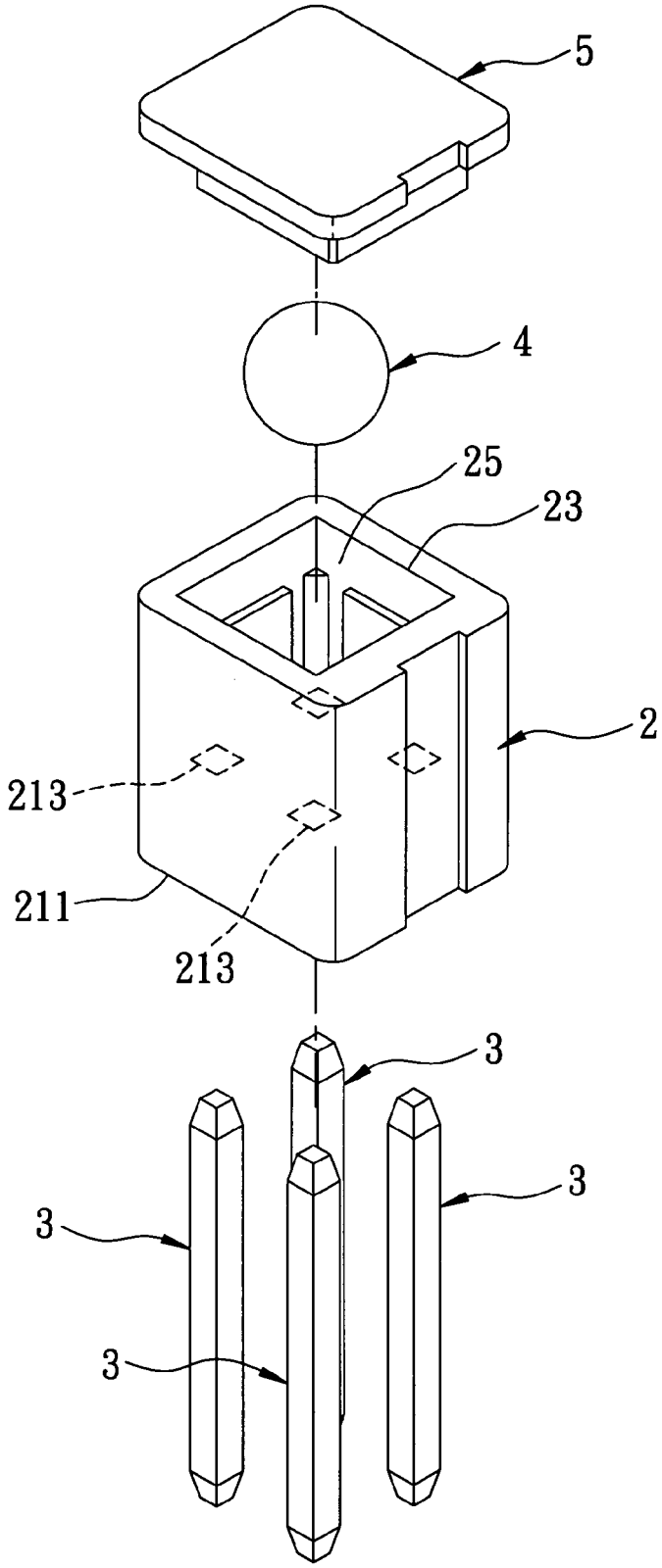
FIG. 21 is an exploded perspective view of the sixth preferred embodiment.
Figure 22:
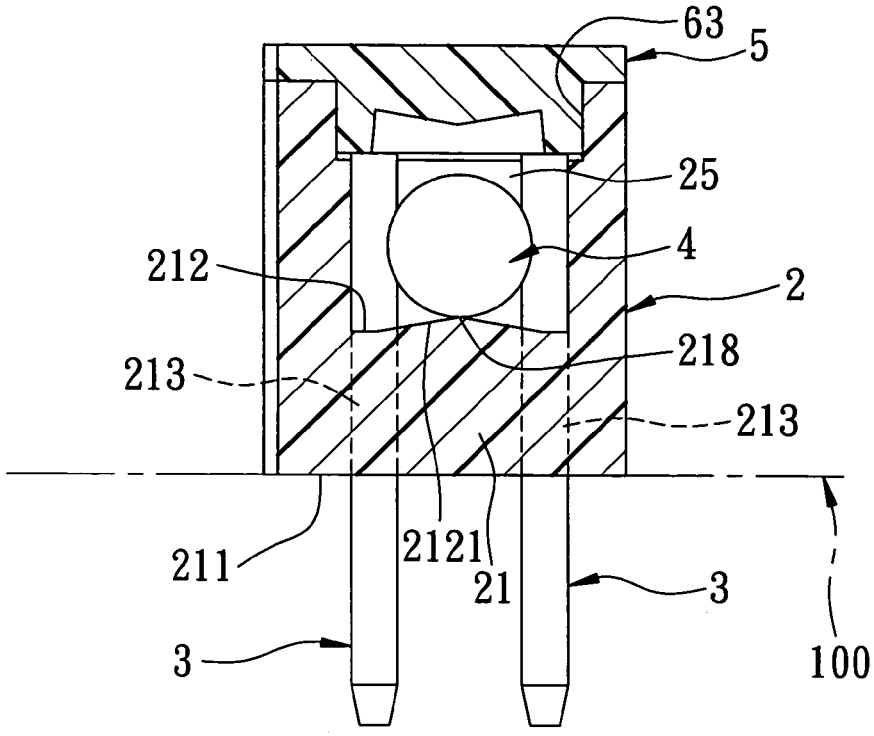
FIG. 22 is a longitudinally sectional view of the sixth preferred embodiment in an upright state, taken along lines 22—22 of FIG. 20.
Figure 23:
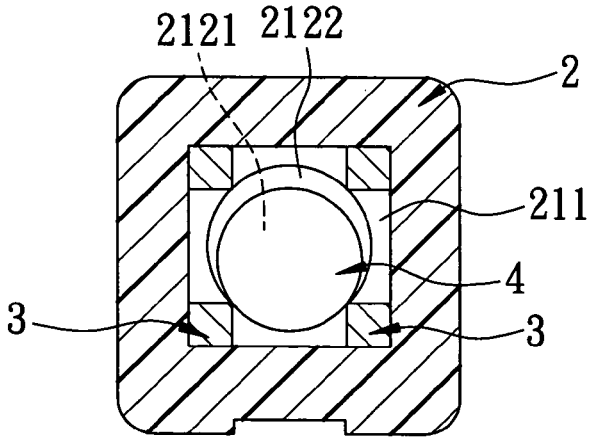
FIG. 23 is a cross-sectional view of the sixth preferred embodiment in the upright state, taken along 23—23 of FIG. 20.
Figure 24:
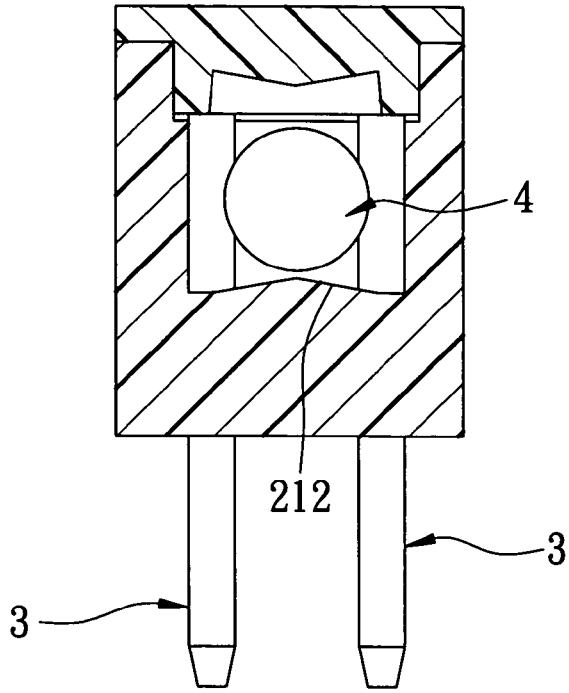
FIGS. 24 and 25 are views similar to FIG. 22 but showing the sixth preferred embodiment in a jerked state.
Figure 25:
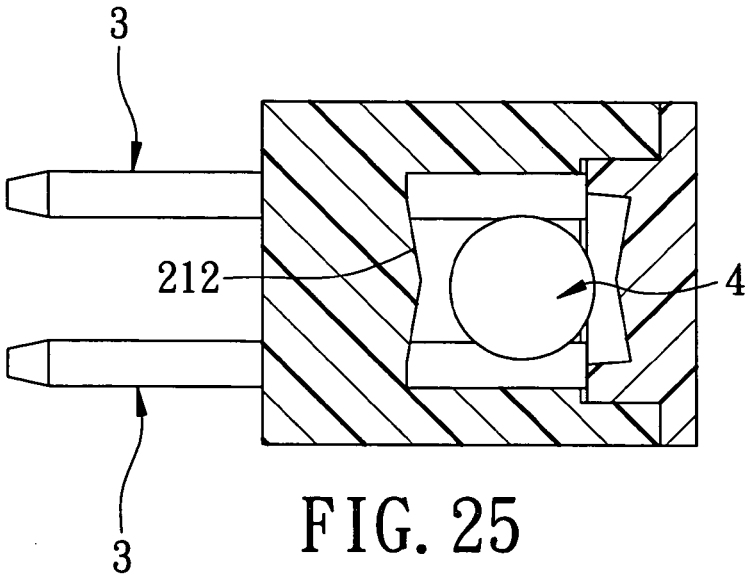
Figure 26:
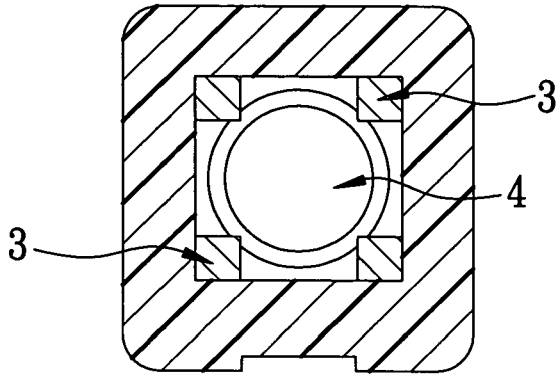
FIG. 26 is a view similar to FIG. 23 but showing the sixth preferred embodiment in the jerked state.

Referring to FIGS. 20 to 22, the sixth preferred embodiment of a jerk-initiated switch according to this invention is shown to be similar to the third preferred embodiment in construction. However, in this embodiment, the central area 2121 is in the form of a convexity with a topmost point 218 thereof located at the centerline such that in the upright position, as shown in FIGS. 22 and 23, the spherical center of the ball 4 is offset from the centerline to enable the ball 4 to engage two adjacent ones of the electric contact terminals 3 so as to establish the electric contact therebetween, thereby placing the switch in a switch-on state. As shown in FIGS. 24 to 26, the ball 4 is flung from the inner bottom wall surface 212 as a result of quivering of the housing (in a vibrated or tilted position), thereby enabling the ball 4 to disengage any two adjacent ones of the electric contact terminals 3 so as to break the electric contact therebetween, thereby placing the switch in a switch-off state.

Figure 27:
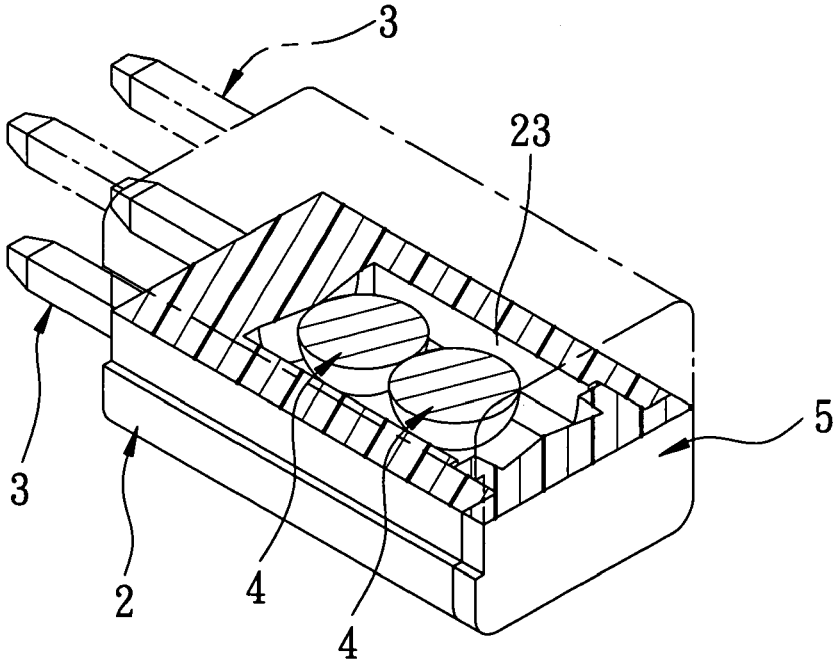
FIG. 27 is a partly cutaway perspective view of a seventh preferred embodiment of the jerk-initiated switch according to this invention.
Figure 28:
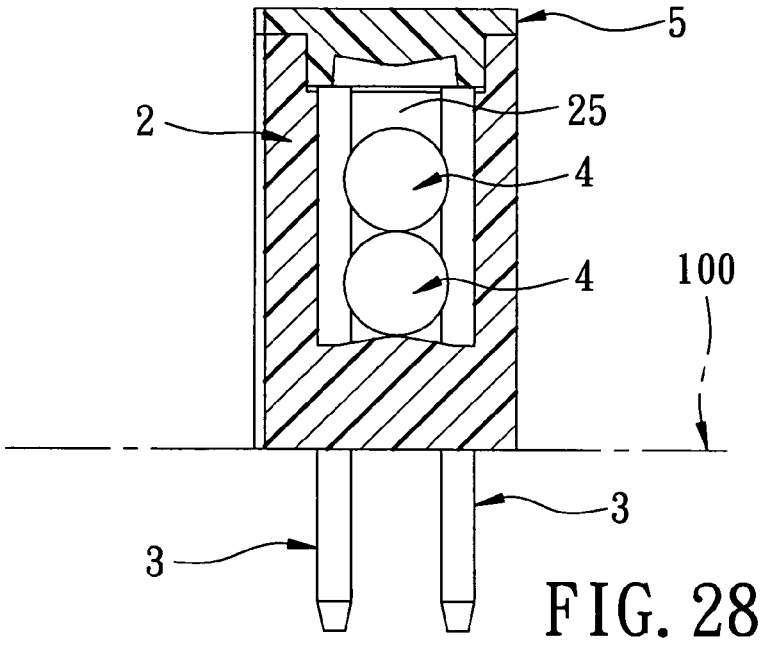
FIG. 28 is a longitudinally sectional view of the seventh preferred embodiment in an upright state.

Referring to FIGS. 27 and 28, the seventh preferred embodiment of a jerk-initiated switch according to this invention is shown to be similar to the sixth preferred embodiment in construction. However, in this embodiment, the inner peripheral wall surface 23 of the housing further extends in the upright direction to increase the height of the accommodation chamber 25. An additional electrically conductive ball 4, which is identical to the electrically conductive ball 4, is superimposed upon the electrically conductive ball 4 so as to ensure engagement of the electrically conductive ball 4 with two adjacent ones of the electric contact terminals 3, thereby warranting the electric contact therebetween.

Figure 29:
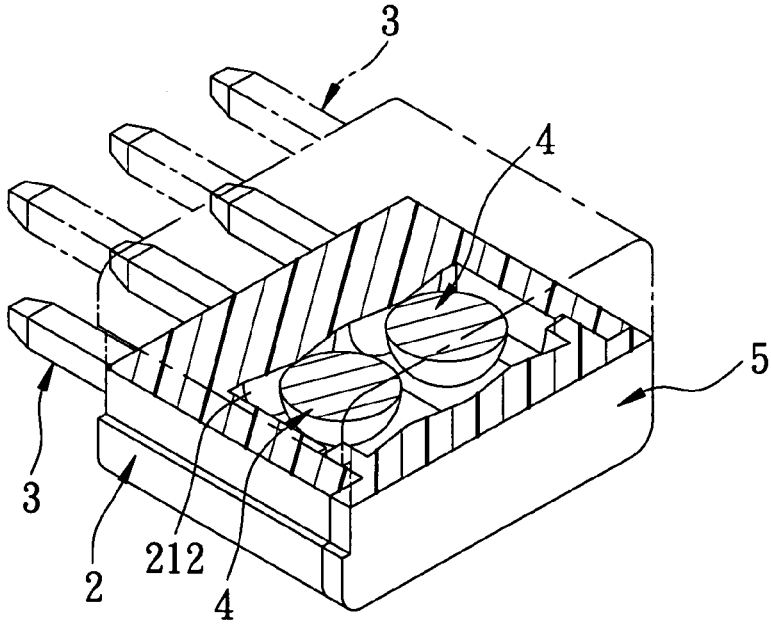
FIG. 29 is a partly cutaway perspective view of an eighth preferred embodiment of the jerk-initiated switch according to this invention.

Referring to FIG. 29, the eighth preferred embodiment of a jerk-initiated switch according to this invention is shown to be similar to the seventh preferred embodiment in construction. However, in this embodiment, the inner bottom wall surface 212 further extends lengthwise to form an additional convexity, and two additional electric contact terminals 3 and an additional electrically conductive ball 4 are provided.

Figure 30:
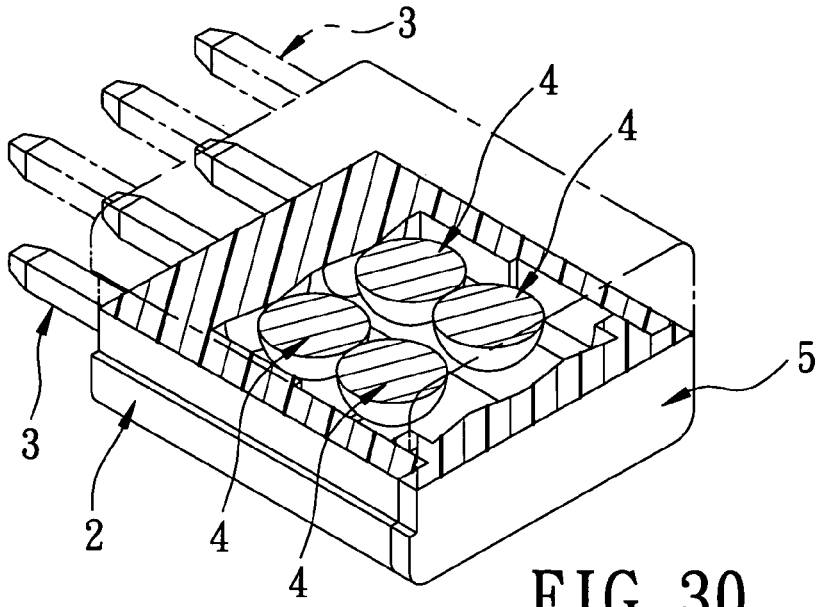
FIG. 30 is a partly cutaway perspective view of a ninth preferred embodiment of the jerk-initiated switch according to this invention.

In the ninth preferred embodiment of a jerk-initiated switch according to this invention as shown in FIG. 30, which is similar to the eighth preferred embodiment in construction, the switch further comprises two additional electrically conductive balls 4 which are respectively superimposed upon the electrically conductive balls 4 and which are identical to the electrically conductive balls 4.

Figure 31:
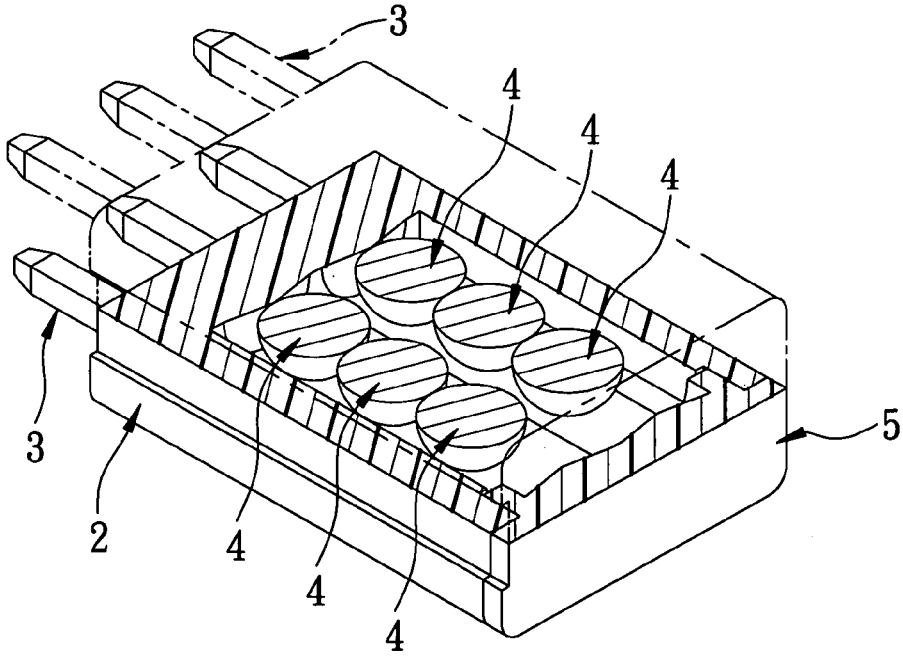
FIG. 31 is a partly cutaway perspective view of a tenth preferred embodiment of the jerk-initiated switch according to this invention.

In the tenth preferred embodiment of a jerk-initiated switch according to this invention as shown in FIG. 31, the switch further comprises two pairs of electrically conductive balls 4 which are identical to the electrically conductive balls 4. The electrically conductive balls 4 of each pair are superimposed upon a respective one of the electrically conductive balls 4.

Figure 32:
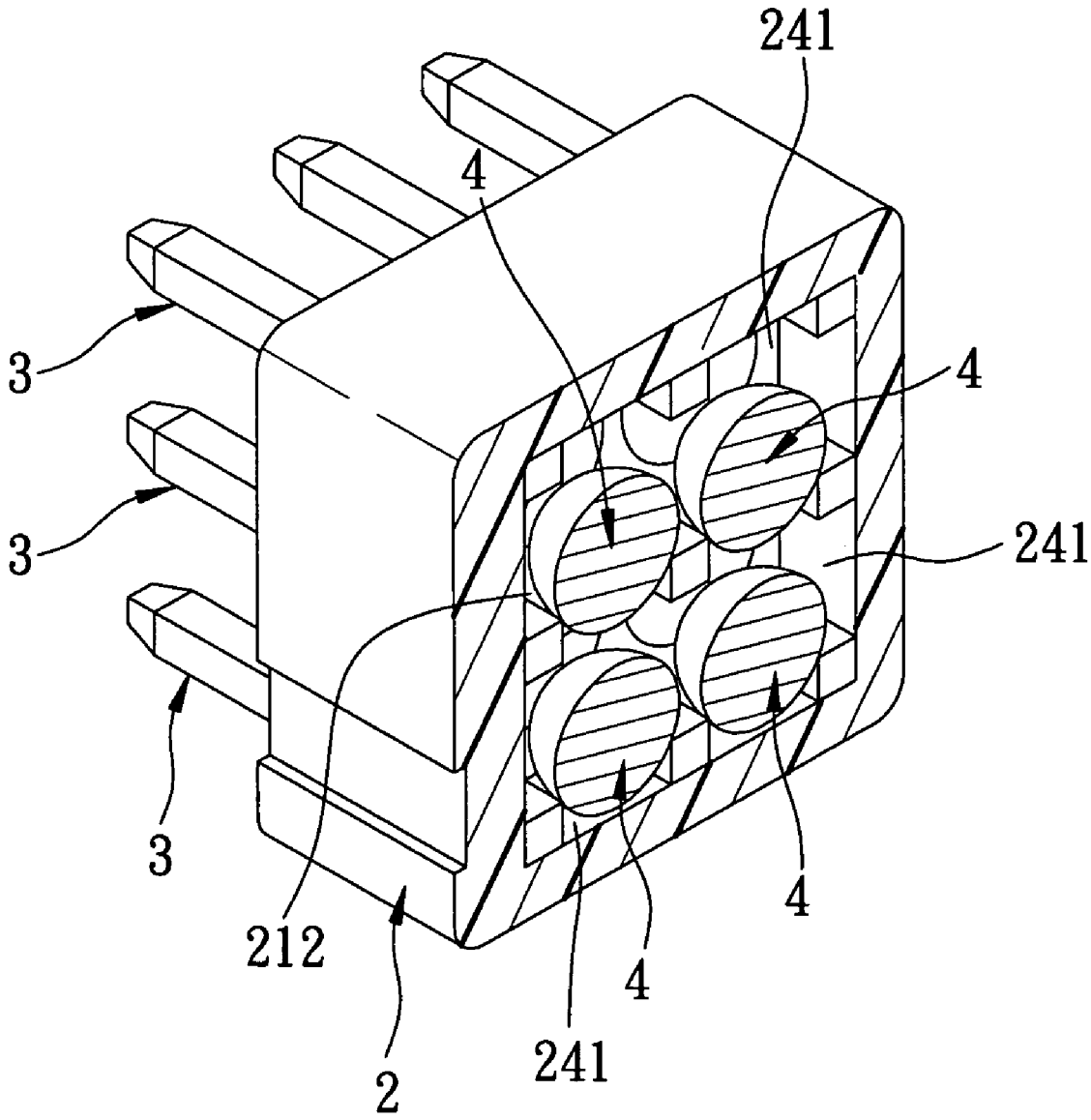
FIG. 32 is a partly cutaway perspective view of an eleventh preferred embodiment of the jerk-initiated switch according to this invention.

In the eleventh preferred embodiment of a jerk-initiated switch according to this invention as shown in FIG. 32, which is similar to the sixth preferred embodiment in construction, the inner bottom wall surface 212 further extends in widthwise and lengthwise directions to form three additional central areas in the form of concavities and three additional circumferential areas. Furthermore, five electric contact terminals 3 are additionally provided to cooperate with the four electric contact terminals 3 to define four squares that respectively confront the four concavities so as to divide the accommodation chamber into four rolling regions 241. The electrically conductive ball 4 and three additional electrically conductive balls 4 are disposed in the rolling regions 241, respectively.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A jerk-initiated switch adapted to be mounted on and to be in electric contact with a support, said jerk-initiated switch comprising:

an insulating housing adapted to be mounted on the support in an upright direction, and having an inner bottom wall surface, and an inner peripheral wall surface which extends upwardly from a periphery of said inner bottom wall surface and which defines an accommodation chamber therein, said inner bottom wall surface having a central area and a circumferential area surrounding said central area;

a plurality of electric contact terminals displaced angularly from one another about a centerline which extends from said central area in the upright direction, each of said electric contact terminals including a shank extending in the upright direction, and a contact protrusion extending radially from said shank and having a portion protruding toward the centerline such that said portions of said contact protrusions form vertices of a polygon that defines a horizontal plane intersecting the centerline at a polygonal center, the polygon having a pair of first vertices connected by a first diagonal and a pair of second vertices connected by a second diagonal, the first and second diagonals passing through the polygonal center, and first and second polygonal sides that interconnect a corresponding one of the first vertices with the second vertices adjacent thereto, the polygonal center being distant from said central area along the centerline, the corresponding one of the first vertices, one of the two second vertices adjacent thereto, the first polygonal side, and the second polygonal side, respectively, by a height, a first diagonal section, a second diagonal section, a first length, and a second length, respectively; and an electrically conductive ball which is disposed to be rollable on said inner bottom wall surface, and which has a spherical radius of a dimension that is larger than both the height and the longer one of the first and second lengths, and that is smaller than the shorter one of the first and second diagonal sections, said central area having a topography which is configured such that said electrically conductive ball is displaced from an upright position, where said electrically conductive ball rests on said central area to establish a first switching state between two adjacent ones of said contact protrusions of said electric contact terminals through one of engagement and disengagement with said electrically conductive ball, to a jerked position, where said electrically conductive ball is jerked out of said central area to establish a second switching state between said two adjacent ones of said contact protrusions the other one of engagement and disengagement with said electrically conductive ball.

2. The jerk-initiated switch of claim 1, wherein the polygon is a square such that the first diagonal section is equal to the second diagonal section, and the first length is equal to the second length.

3. The jerk-initiated switch of claim 2, wherein said central area is in form of a concavity and converges from to the centerline such that in the upright position, a spherical center of said ball is located at the centerline to enable said ball to disengage said two adjacent ones of said contact protrusions to break electric contact therebetween, thereby placing said switch in the first switching state, and such that in the jerked position, said ball is displaced to said circumferential area to engage said two adjacent ones of said contact protrusions so as to establish the electric contact therebetween, thereby placing said switch in the second switching state.

4. The jerk-initiated switch of claim 3, further comprising an insulating cap which has a periphery abutting against said inner peripheral wall surface, and which is spaced apart from said inner bottom wall surface in the upright direction to define said accommodation chamber.

5. The jerk-initiated switch of claim 4, wherein said insulating cap has an inner top wall surface which confronts said inner bottom wall surface, said inner top wall surface having a topography which is configured to be a mirror image of said inner bottom wall surface so as to ensure that said ball rests on said circumferential area when said ball is in the jerked position.

6. The jerk-initiated switch of claim 2, wherein said central area is in form of a convexity with a topmost point located at the centerline such that in the upright position, the spherical center of said ball is offset from the centerline as a result of gravity to enable said ball to engage said two adjacent ones of said contact protrusions so as to establish the electric contact therebetween, thereby placing said switch in the first switching state, and such that said ball is flung out of said inner bottom wall surface as a result of quivering of said housing to enable said ball to disengage said two adjacent ones of said contact protrusions so as to break the electric contact therebetween, thereby placing said switch in the second switching state.

7. The jerk-initiated switch of claim 6, further comprising an additional electrically conductive ball which is superimposed upon said ball so as to ensure engagement of said electrically conductive ball with said two adjacent ones of said contact protrusions, thereby warranting electric contact therebetween.

8. The jerk-initiated switch of claim 2, wherein said inner bottom wall surface extends outwardly of two contiguous ones of said electric contact terminals to form an additional central area and an additional circumferential area, said switch further comprising:

two additional electric contact terminals, said additional electric contact terminals and said two contiguous ones of said electric contact terminals being angularly displaced from one another around said additional central area, said additional electric contact terminals including contact protrusions that cooperate with said contact protrusions of said two contiguous ones of said electric contact terminals to form four vertices of a square, said additional central and circumferential areas and said additional electric contact terminals being configured to be identical to said central and circumferential areas and said electric contact terminals; and an additional electrically conductive ball which is configured to be identical to said electric conductive ball, and which is rollable on said additional central area and said additional circumferential area so as to engage or disengage two adjacent ones of said contact protrusions of said additional electric contact terminals and said two contiguous ones of said electric contact terminals.

9. The jerk-initiated switch of claim 1, wherein said housing has an outer bottom wall surface opposite to said inner bottom wall surface and adapted to be mounted on the support, said outer bottom wall surface having a plurality of through holes which extend through said inner bottom wall surface in the upright direction to provide access to said accommodation chamber, said shanks of said electric contact terminals being respectively received in and extending outwardly of said through holes.

10. The jerk-initiated switch of claim 9, wherein said housing is made of modular upper and lower halves fitted to each other, said through holes being formed in said lower half, said upper half having a plurality of mounting holes which extend therethrough and which are respectively registered with said through holes in the upright direction, each of said shanks of said electric contact terminals having upper and lower segments which are respectively received in a respective one of said mounting holes and a corresponding one of said through holes such that said contact protrusions of said electric contact terminals are located in the horizontal plane.

* * * * *